US005701971A

United States Patent [19]

Rchid

[11] Patent Number: 5,701,971

[45] Date of Patent: Dec. 30, 1997

[54] PROTECTIVE MEMBER FOR METAL SCAFFOLD KNOTS OR JOINTS

[76] Inventor: Abazid Amin Rchid, Via Liguria 11, 50145 Firenze, Italy

[21] Appl. No.: 545,247

[22] Filed: Oct. 19, 1995

[30] Foreign Application Priority Data

Nov. 7, 1994 [IT] Italy ..... FI940116 U

[51] Int. Cl.[6] ..... E04G 1/00

[52] U.S. Cl. ..... 182/179; 182/129; 182/178; 403/385; 403/391; 403/396; 403/400

[58] Field of Search ..... 182/129, 178, 182/179; 403/346, 385, 391, 396, 400

[56] References Cited

U.S. PATENT DOCUMENTS

| | | | |
|---|---|---|---|
| 1,931,400 | 10/1933 | Williams | 403/385 |
| 1,950,635 | 3/1934 | Steinmayer | 403/400 X |
| 3,096,110 | 7/1963 | Cantor | 403/385 |
| 3,358,789 | 12/1967 | Laun | 182/187 |
| 4,784,514 | 11/1988 | Pantev | 403/400 X |
| 5,038,889 | 8/1991 | Jankowski | 182/129 |
| 5,118,215 | 6/1992 | Freier | 248/74.2 X |
| 5,165,815 | 11/1992 | Allen | 403/391 X |
| 5,280,866 | 1/1994 | Ueki | 248/74.2 |
| 5,282,555 | 2/1994 | Muir et al. | 403/391 X |
| 5,395,018 | 3/1995 | Studdiford | 403/400 X |
| 5,498,098 | 3/1996 | Cairns | 403/400 |

*Primary Examiner*—Alvin C. Chin-Shue
*Assistant Examiner*—Richard M. Smith
*Attorney, Agent, or Firm*—McGlew and Tuttle

[57] ABSTRACT

Protective member for metal knots or joints of scaffolds having horizontal and vertical tubular elements connected by a clamp at each knot, said protective member being made up of two parts (C1) and (C2) each of which consists of a hollow body (1) including a first pair of aligned coaxial semicircular seats (2) and two further semicircular aligned and coaxial seats (3, 4) whose axis is orthogonal to that of the first seats (2) and suitably spaced therefrom, the first seats (2) being intended to fit, with light elastic forcible engagement, the horizontal tube (5) of the scaffold knot, the other two seats (3, 4) being intended to fit the corresponding vertical tube (6) of the knot, or vice versa, and the two parts (C1, C2) of the protective member being mutually orthogonal, that is, rotated through 90° with respect to each other, and located on opposite sides of the knot.

12 Claims, 3 Drawing Sheets

PROTECTIVE MEMBER FOR METAL SCAFFOLD KNOTS OR JOINTS

FIELD OF THE INVENTION

The present invention refers to a protective member for knots or joints of metal scaffolds.

BACKGROUND OF THE INVENTION

Metal scaffolds are known of being made up of a plurality of tubes suitably connected to each other through clamps and relevant tightening screw means in correspondence of the scaffold knots: a scaffold knot being a point of a scaffold where a vertical and a horizontal tube are joined together. However, in correspondence of said knots, that is, of the clamps seats, the shanks of the tightening screws are mostly uncovered and protruding from the knots, which puts at risk the safety of passers-by and of the same operators.

SUMMARY AND OBJECTS OF THE INVENTION

The main object of the present invention is to overcome the above mentioned drawback.

This result has been achieved, according to the invention, by adopting the idea of making a protective member having the characteristics of first and second parts, each of which includes a hollow body defining first and second pairs of semi-circular aligned coaxial seats. The pairs of seats being substantially orthogonal and spaced from each other. The seats being shaped to engage tubular elements held by the clamp of the scaffolding knot. The two parts being mutually orthogonal when rotated through ninety degrees with respect to each other and located on opposite sides of the scaffold knot. The first and second parts are substantially complementary for engaging with each other and the tubular elements when they are on opposite sides of the clamp. The parts are hollow and define a cavity for receiving and surrounding the clamp when the parts are positioned on opposite sides of the clamp holding the tubular members. Other characteristics of the present invention are disclosed in the dependent claims.

The advantages of the present invention lie essentially in that it is possible to provide an effective safety covering protecting means, in correspondence of the seats of the clamps of the metal scaffold, in a simple and definite manner; that the joint cover according to the invention is easy to make, cost-effective, and reliable even after a long service life.

BRIEF DESCRIPTION OF THE DRAWINGS

These and other advantages and characteristics of the present invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1:
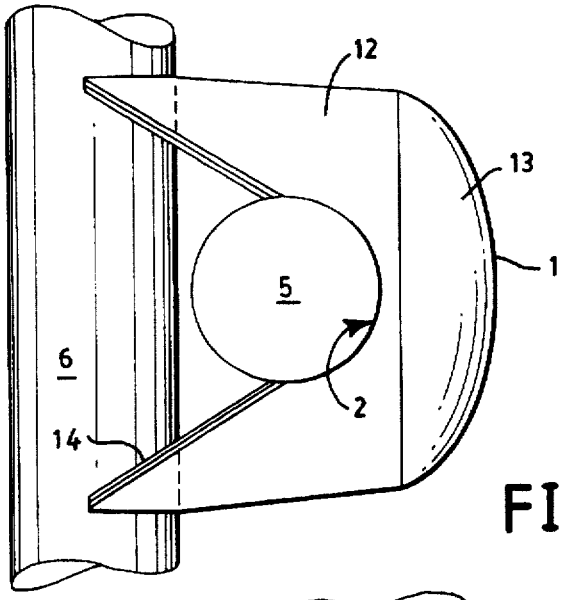
FIG. 1 is a front view of one of the two bodies of a protective member for scaffold knots in metal tubes, according to the invention, in use.

Reduced to its basic structure and reference being made to the figures of the accompanying drawings, a protective member for scaffold knots in metal tubes, with horizontal and vertical tubes, according to the invention, is made up of two parts (C1, C2) each of which consists of a hollow body (1) defining a cavity and including a first pair of semicircular aligned coaxial seats (2) and two further semicircular aligned and coaxial seats (3, 4) whose axis is orthogonal to that of the first seats (2) and suitably spaced therefrom. The first seats (2) are intended to fit, with light elastic forcible engagement, the horizontal tube (5) of the scaffold knot. The other two seats (3, 4) are intended to fit the corresponding vertical tube (6) of the knot (or vice versa). The said two parts (C1, C2) of the protective member are mutually orthogonal, that is, rotated through 90° with respect to each other, and located on opposite sides of the scaffold knot. The said parts (C1, C2) thus receive, cover and protect the scaffold knot and the relevant clamp or tube joining means (8). Tubes and relevant joining means are per se known to those skilled in the art and not further disclosed in the present specification.

Figure 2:
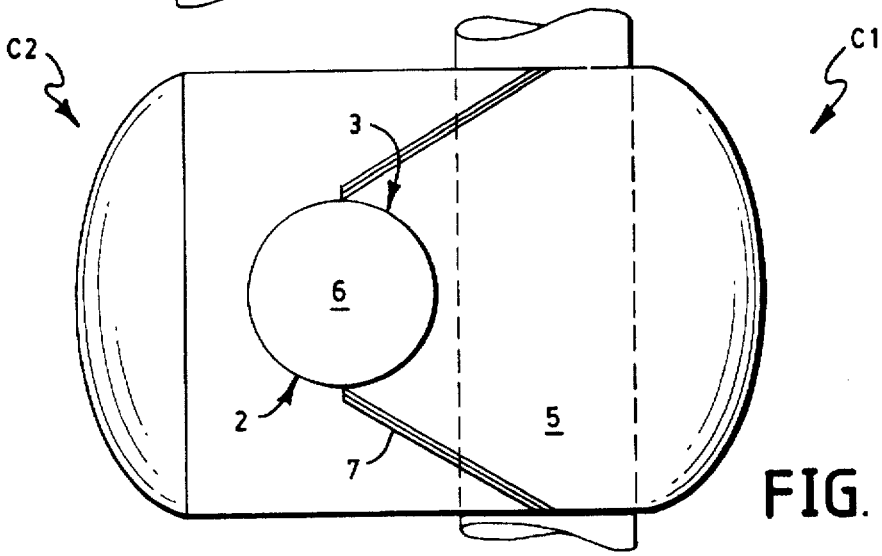
FIG. 2 is a plan view of a protective member, according to the invention, in use.
Figure 3:
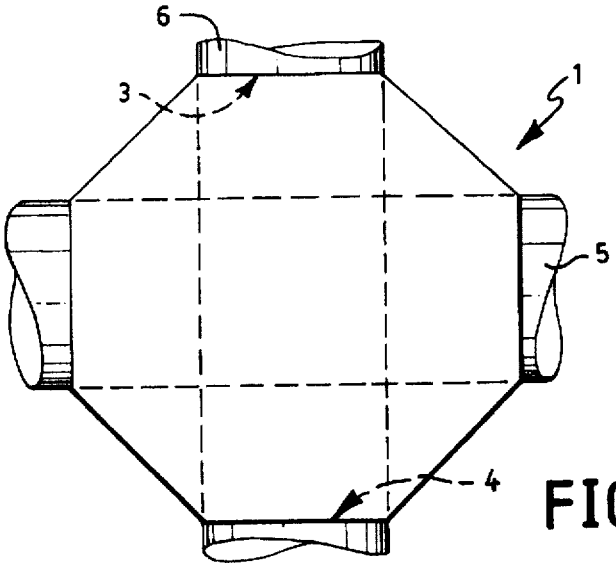
FIG. 3 is a side view of the member of FIG. 2.

To improve the fit, each of said parts (C1, C2) is provided with peripheral tongues (7) on edges as shown in FIGS. 1 and 2 intended to engage, either by friction or fixed joint, the corresponding regions of the other part (C1, C2).

Advantageously, according to the invention, each of said parts (C1, C2) is provided inside with a cavity structure, not shown for sake of clarity in the figures of the accompanying drawings, to allow it to be fixedly but removably fit on the head of one or more corresponding nuts (80), or relevant shanks, of the clamp (8), and/or on the body of the same clamp (8).

Advantageously, according to the invention, a strap 15 for clamping said parts (C1, C2), is provided in correspondence of the respective seats (2, 3, 4) engaging the two tubes (5, 6) of the knot.

Figure 4:
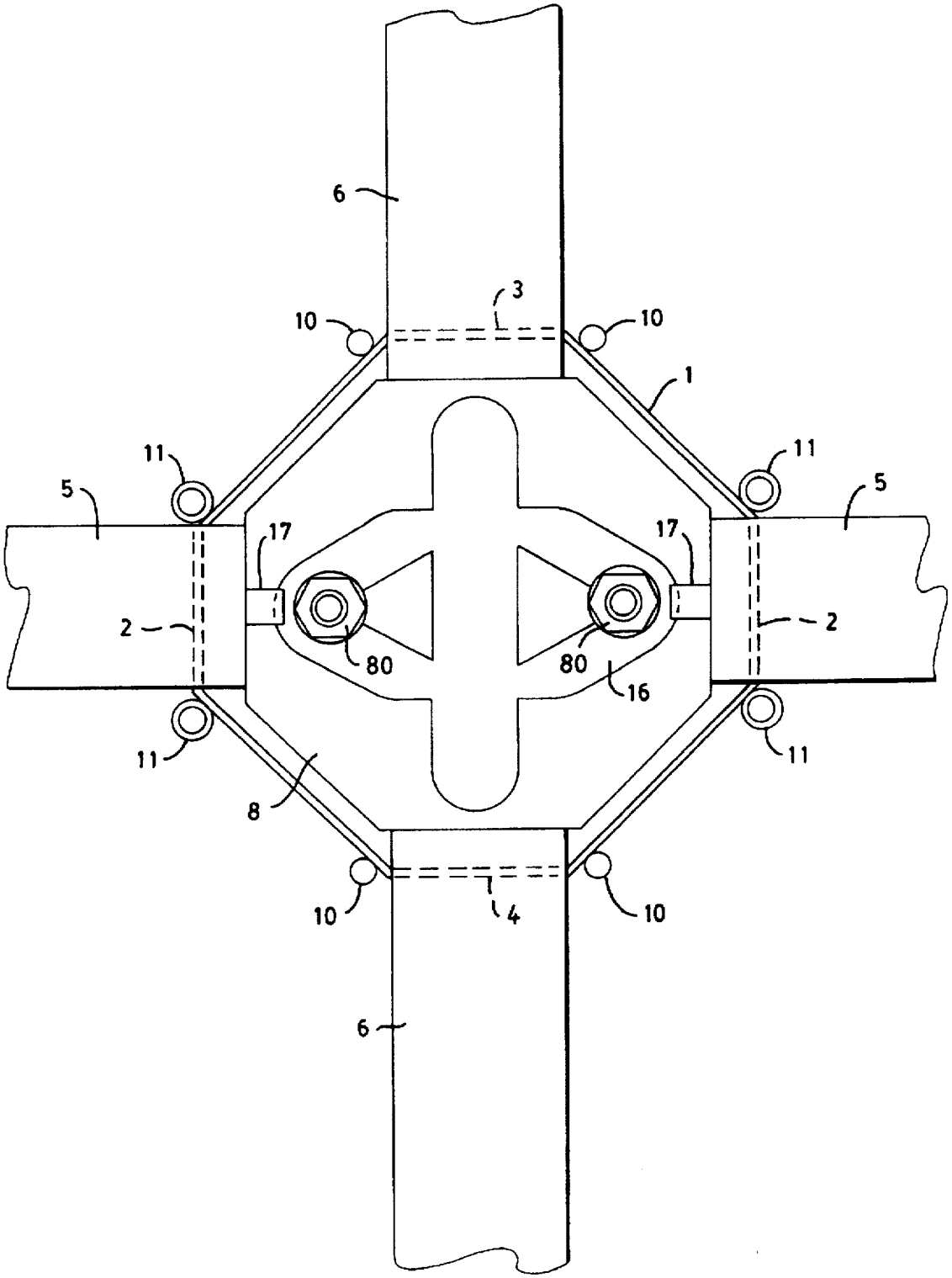
FIG. 4 is a schematic front view of a scaffold knot partially provided with a protective member according to the invention.
Figure 5:
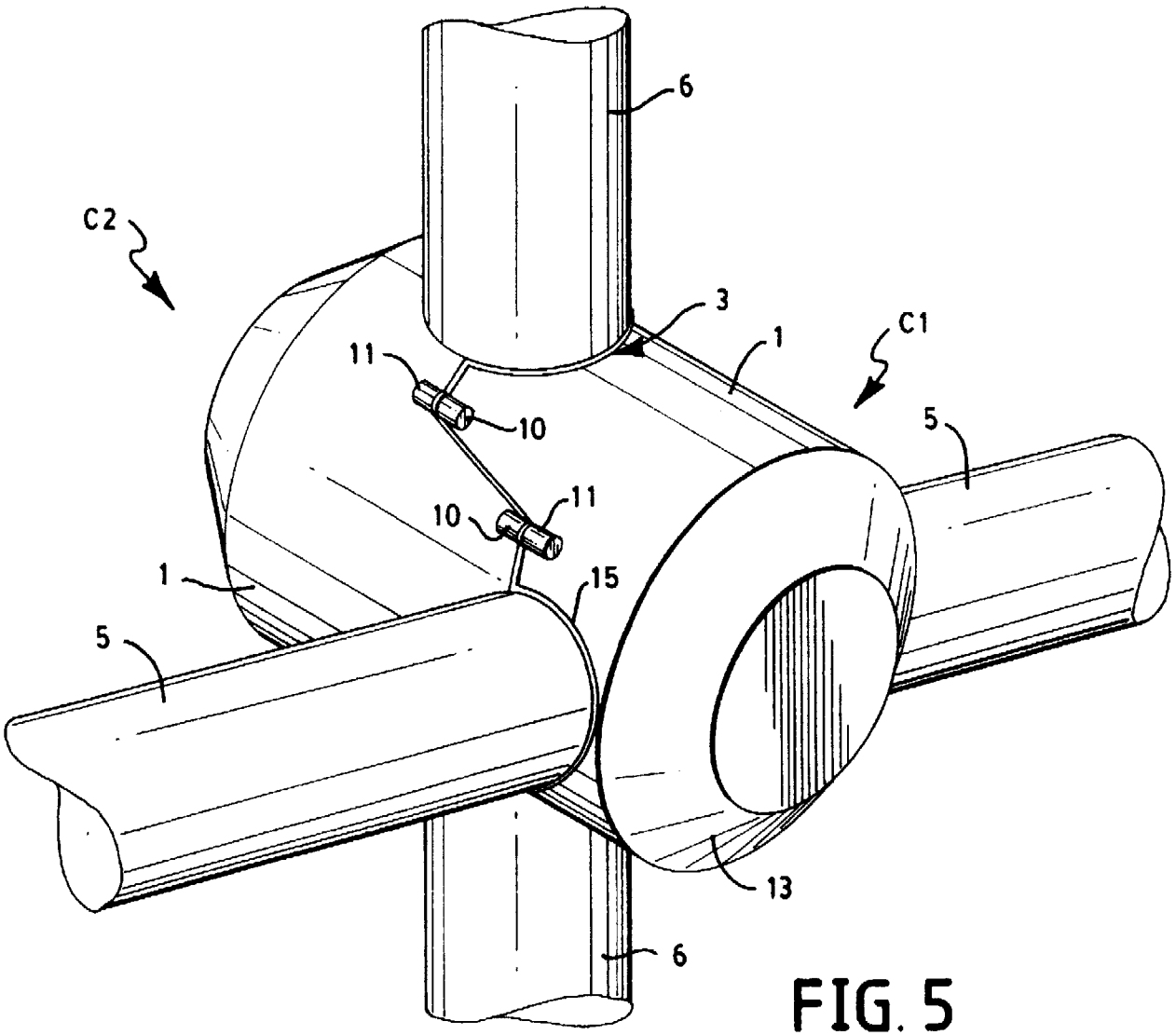
FIG. 5 is a schematic perspective view of a protective member according to the invention.

Moreover, advantageously, each of said parts (C1, C2) is provided with an elastic tongue 17, having a pawl for the hooking thereof, by light enforcible engagement, on the body 16 of the clamp. Furthermore, in order to connect the said parts (C1, C2) to each other, the hollow bodies (1) are provided with plugs (10) and corresponding bushes (11), as shown in FIGS. 4 and 5. The said parts (C1, C2) can be made, by way of example, of conventional molded plastic material by a hollow cylindrical section 12 with a cap 13 on one end and an engaging end 14 on the other.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

I claim:

1. A protective cover for a clamp of a scaffold, the protective member comprising:

first and second parts each being substantially identical, each part defining a first and second pair of semi-circular coaxial aligned seats, said pairs of seats being shaped to engage tubular elements held by the clamp, said pairs of seats being substantially orthogonal to each other, said first and second parts being shaped to he substantially complementary for engaging with each other and the tubular elements when one said part is rotated through 90 degrees with respect to the other said part and said parts are positioned on opposite sides of the clamp holding the tubular members, said parts being hollow and defining a cavity for receiving and surrounding the clamp when said parts are positioned on opposite sides of the clamp holding the tubular members, each of said parts has an engaging end for engaging with each other and the tubular elements when said parts are positioned on opposite sides of the clamp, said engaging end having one of said pairs of seats spaced from the other of said pairs of seats and defining a V-shaped opening leading from said one of said pairs of seats to said other of said pairs of seats.

2. Protective cover according to claim 1, wherein each of said two parts is provided with peripheral tongues intended to engage, either by friction or fixed joint, corresponding regions of said another part.

3. Protective cover according to claim 1, wherein:

each of said two parts is provided on an inside with a cavity structure for fixedly and removably fitting a respective part on a head of one of corresponding nuts, shanks, and body of the clamp.

4. Protective cover according to claim 1, wherein:

said parts include a strap for clamping said two parts, said strap being provided in correspondence with the respective seats for engaging the tubular members.

5. Protective cover according to claim 1, wherein:

each of said two parts is provided with an elastic tongue having a pawl for the hooking thereof, by light enforceable engagement, on the clamp.

6. Protective cover according to claim 1, wherein:

plugs and corresponding bushes are positioned on said first and second parts.

7. Protective cover according to claim 2, wherein:

each of said two parts is provided inside with a cavity structure for fixedly and removably fitting a respective part on one of a nut, shank and body of the clamp.

8. Protective cover according to claim 2, wherein:

said parts include a strap for clamping said two parts, said strap being provided in correspondence of the respective seats engaging the tubular members.

9. Protective cover according to claim 2, wherein:

each of said two parts is provided with an elastic tongue having a pawl for the hooking thereof, by light enforceable engagement, on the clamp.

10. A protective cover in accordance with claim 1, wherein:

said first and second parts block access to the clamp when said first and second parts are positioned on opposite sides of the clamp and engaged with each other and the tubular members.

11. A protective cover in accordance with claim 1, wherein:

said first and second parts are formed of a hollow cylindrical section with a cap on one axial end opposite from the engaging end.

12. A protective cover in accordance with claim 1, wherein:

edges of said engaging ends include tongues for engaging with corresponding tongues of said another part.

* * * * *